United States Patent [19]

Chudner

[11] 4,024,641

[45] May 24, 1977

[54] INSTRUMENT FOR DRAWING GEOMETRIC FIGURES

[76] Inventor: Joseph Chudner, 2907 Brighton 8th St., New York, N.Y. 11235

[22] Filed: Oct. 16, 1975

[21] Appl. No.: 623,125

[52] U.S. Cl. ..... 33/30 B; 33/27 K

[51] Int. Cl.[2] ..... B43L 11/04

[58] Field of Search ..... 33/30, 27 K, 23 H

[56] References Cited

UNITED STATES PATENTS

| | | | |
|---|---|---|---|
| 324,395 | 8/1885 | Marichal | 33/30 C |
| 2,048,935 | 7/1936 | Klages | 33/27 K |
| 2,095,116 | 10/1937 | Albin | 33/27 K |

FOREIGN PATENTS OR APPLICATIONS

| | | | |
|---|---|---|---|
| 12,101 | 3/1956 | Germany | 33/30 |

OTHER PUBLICATIONS

John Hick, Ellipsograph, Mar. 1844, Journal of Franklin Institute vol. 37, p. 153.

*Primary Examiner*—Richard E. Aegerter
*Assistant Examiner*—John W. Shepperd
*Attorney, Agent, or Firm*—Blum, Moscovitz, Friedman & Kaplan

[57] ABSTRACT

An instrument for producing on the surface of a given sheet material a given geometric figure having preselected maximum width and length dimensions. A base through a suitable connecting structure carries a marking assembly which is freely movable with respect to the base and which has an inscribing member for inscribing on the surface of the sheet material the given geometric figure. An elongated bar is connected by a lower universal joint to the marking assembly and has an upper end adapted to be manipulated by the operator. Between its ends the bar extends slidably through an upper universal joint which can be adjusted in elevation so as to select a point along the bar about which the latter can be tilted in all directions. A template is formed with an opening through which the bar extends, the template having an inner peripheral edge conforming to the general configuration of the geometric figure which may, for example, be an ellipse, and a template-adjusting structure is operatively connected with the template for adjusting the angle of inclination thereof, the inner peripheral edge of the template limiting the extent to which the bar is tilted with respect to the above point while the bar is moved along the inner peripheral edge of the template to provide the given geometric figure on the surface of the sheet material. By way of adjusting the inclination of the template as well as the elevation of the universal joint through which the bar slidably extends it is possible to determine the maximum dimensions, namely the maximum length and maximum width, of the geometric figure.

12 Claims, 15 Drawing Figures

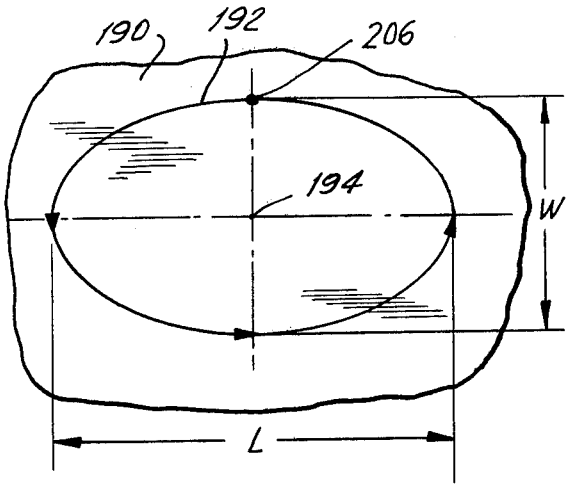
FIG. 4
FIG. 3
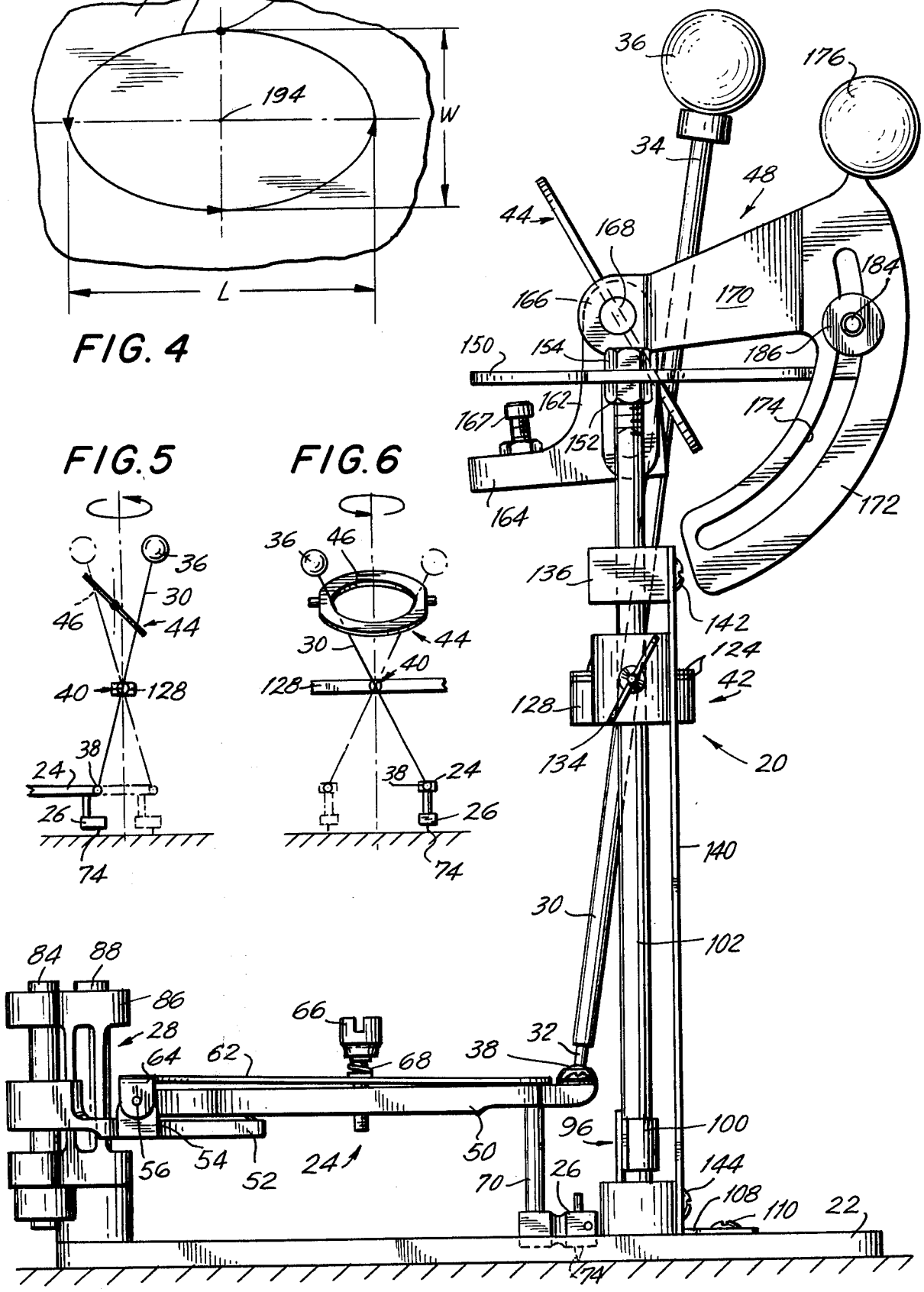
FIG. 5
FIG. 6

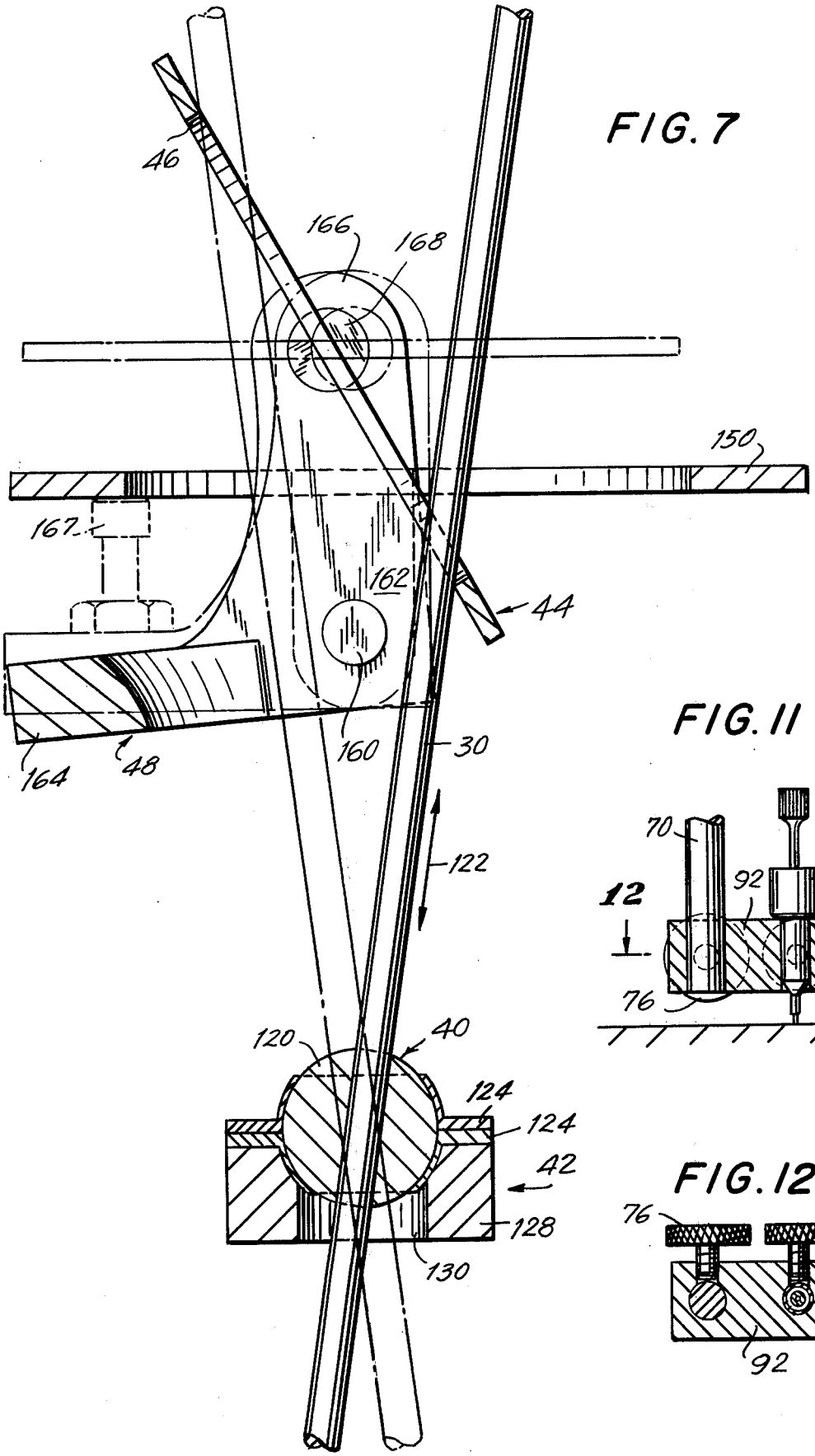
FIG. 7
FIG. 11
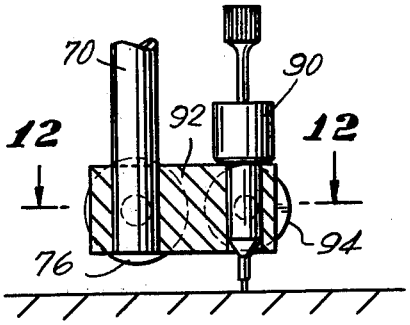
FIG. 12
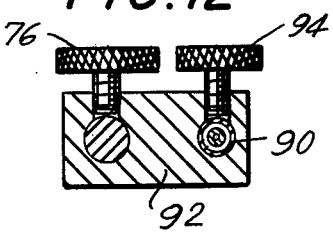

INSTRUMENT FOR DRAWING GEOMETRIC FIGURES

BACKGROUND OF THE INVENTION

The present invention relates to drawing instruments.

In particular, the present invention relates to drawing instruments which are adapted to be used in connection with inscribing given geometric figures on the surface of a sheet material.

At the present time, geometric figures are drawn on the surface of a sheet material such as paper by the use of a suitable template which takes the form of a sheet of plastic material which has punched therethrough a number of openings of different sizes and having configurations conforming to the particular geometric figures. For example in the case of ellipses such a sheet of plastic will have punched therethrough elliptical openings of various sizes, and of course the draftsman must select one of these elliptical openings as a guide for drawing a given ellipse. Of couse, the same procedures are involved in connection with other geometric figures.

These conventional procedures involve a considerable inconvenience and have relatively large inaccuracies inherent therein inasmuch as the draftsman can only select by eye a suitable opening of the desired configuration and then must position the template so that the selected opening is properly oriented prior to moving his pencil or pen along the edge which defines the selected opening.

SUMMARY OF THE INVENTION

It is a primary object of the present invention to provide a drawing instrument which will avoid the drawbacks encoutered with conventional instruments as presently known.

In particular, it is an object of the present invention to provide a single instrument which may be adjusted so as to be capable of producing a given geometric figure in various sizes and with various relationships between its maximum length and width.

In particular it is an object of the present invention to provide an instrument of this latter type which can easily be adjusted very quickly by the operator both with respect to the maximum length and with respect to the maximum width desired for the particular geometric figure.

It is especially an object of the present invention to provide an instrument of this type which can be used in connection with ellipses.

Also, it is an object of the present invention to provide an instrument of the above type which can very accurately locate the center of the geometric figure which is drawn on the surface of the sheet material.

In addition it is an object of the present invention to provide an instrument of the above general type which is of relatively low cost and highly stable so that the desired geometric figure can be produced with a relatively high degree of accuracy.

According to the invention the instrument for producing on the surface of a sheet material a given geometric figure which has a preselected maximum length and a preselected maximum width includes a base means which is adapted to rest on the surface of the sheet material during formation of the given geometric figure thereon. A marking means is adapted to carry an inscribing member which has a tip for engaging the surface of the sheet material for inscribing the given figure thereon. A connecting means is operatively connected with the base means and marking means for supporting the marking means while providing for the marking means complete freedom of movement with respect to the base means. An elongated manually operable bar means has a lower end next to the marking means and an upper end distant therefrom and adapted to be manipulated by the operator. A lower universal joint means connects the lower end of the bar means to the marking means for providing a universal joint connection between the marking means and the bar means at the lower end of the latter. An upper universal joint means surrounds and engages the bar means between the upper and lower ends thereof and is freely shiftable longitudinally of the bar means for providing at a selected location longitudinally of the bar means a point about which the bar means can be manually turned in all directions. A joint-adjusting means is carried by the base means and operatively connected with the upper universal joint means for adjusting the elevation thereof with respect to the base means so as to determine the location of the above point along the bar means. A template means is provided for guiding the bar means when the latter is manipulated by the operator during turning with respect to this point, this template means being situated along the bar means at an elevation different from the upper universal joint means, preferably above the latter, and being formed with an opening through which the bar means extends. This template has an inner peripheral edge which defines the latter opening and which has the general configuration of the given figure which is to be produced on the sheet material. A template adjusting means is also carried by the base means and is operatively connected with the template means for adjusting the latter with respect to the bar means so as to control the extent to which the bar means can be tilted about the above point as the bar means is moved along the inner peripheral edge of the template to provide by way of the marking means the given figure on the surface of the sheet material. The adjustment of the upper universal joint means and the template means by way of the joint-adjusting means and template-adjusting means determines the magnitude of the geometric figure which is produced on the surface of the sheet material as well as the relationship between the maximum length and maximum width thereof.

BRIEF DESCRIPTION OF DRAWINGS

The invention is illustrated by way of example in the accompanying drawings which form part of this application and in which:

FIG. 3 is a side elevation of the instrument of FIGS. 1 and 2, as seen from the left of FIGS. 1 and 2;

FIG. 4 is an illustration of a geometric figure produced with the structure of FIGS. 1–3;

FIG. 5 is a schematic illustration of the manner in which the structure of the invention operates to determine the maximum width of the geometric figure;

FIG. 6 is a schematic illustration of the manner in which the structure of the invention operates to determine the maximum length of the geometric figure;

FIG. 7 is a fragmentary sectional elevation taken along line 7—7 of FIG. 2 in the direction of the arrows and showing details of adjustable structure for controlling the movement by the operator of a bar means of the instrument;

FIG. 11 is a fragmentary partly sectional elevation of structure shown at their right portion of FIG. 8 and adapted to be used with a pen rather than a pencil;

FIG. 12 is a sectional plan view taken along line 12—12 of FIG. 11 in the direction of the arrows.

DESCRIPTION OF A PREFERRED EMBODIMENT

Figure 1:
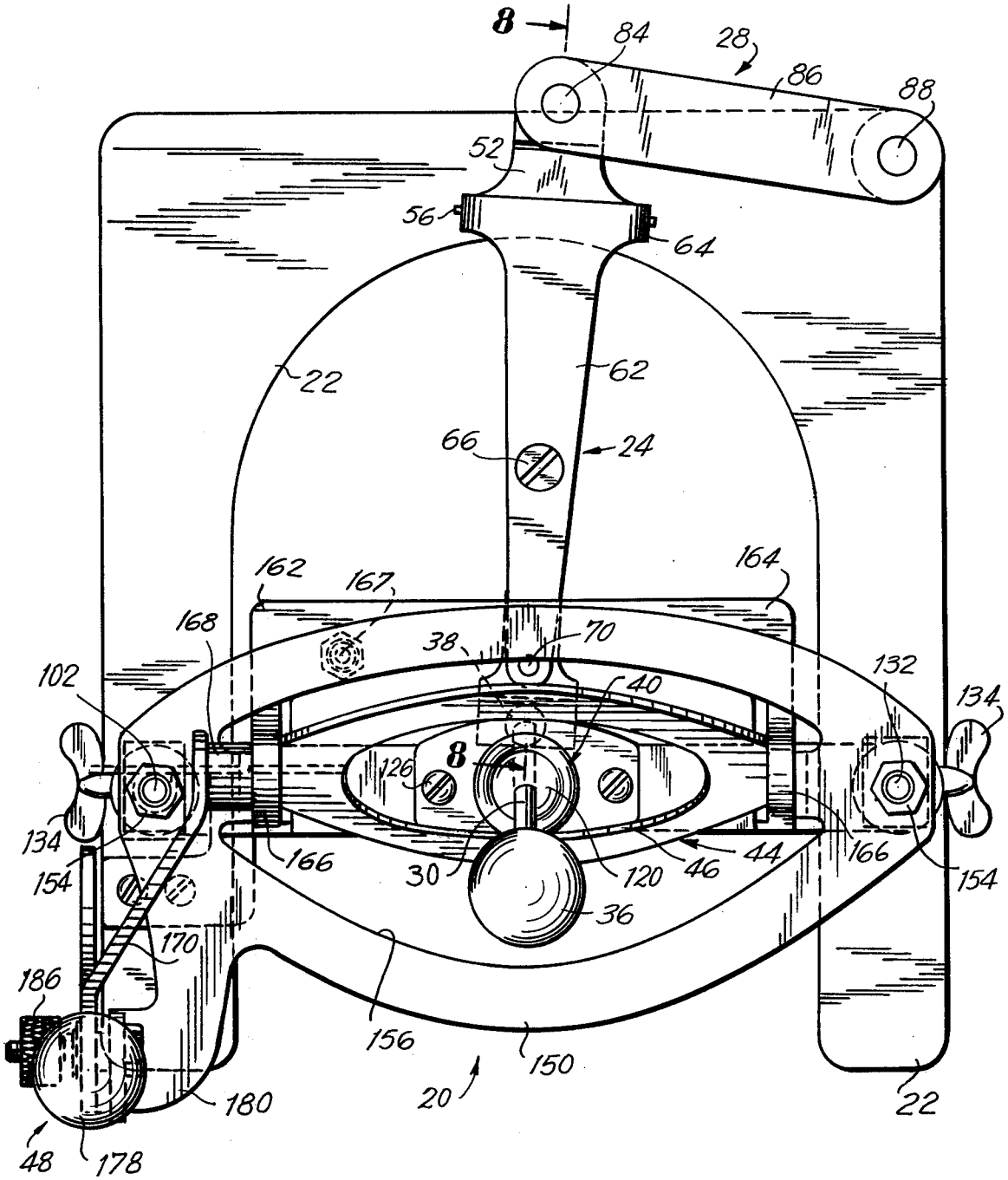
FIG. 1 is a top plan view of an instrument according to the invention.
Figure 2:
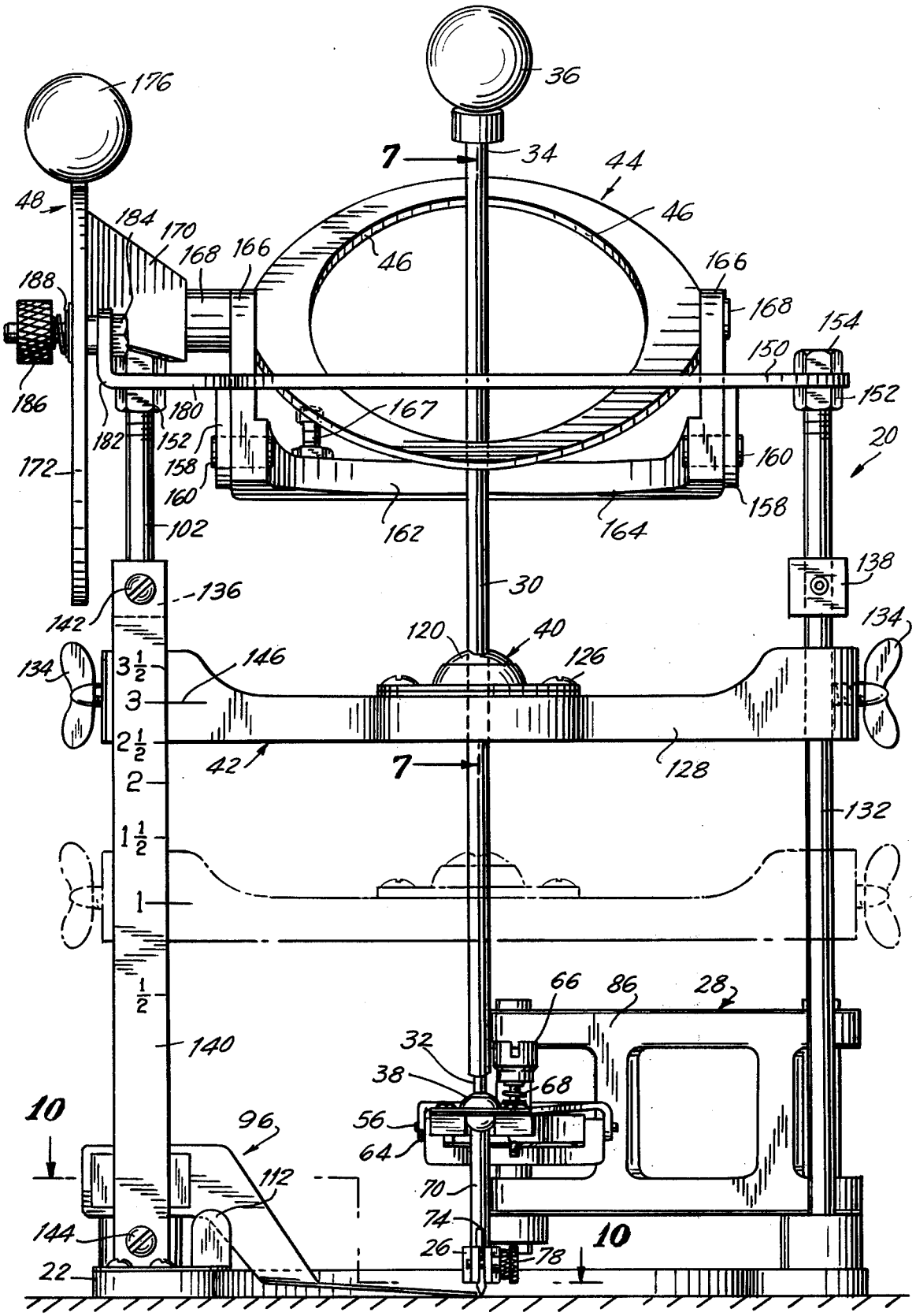
FIG. 2 is a front elevation of the instrument shown in FIG. 1.

Referring now to FIGS. 1–3, it will be seen that the instrument 20 of the present invention which is illustrated therein includes a base means 22 in the form of a flat substantially rigid member made of any suitable plastic or metal and having a generally U-shaped configuration as is apparent from FIG. 1. The lower flat surface of the base means 22 is adapted to rest directly on the surface of the sheet material on which the geometric figure is to be inscribed.

Situated over the space between the opposed side legs of the substantially U-shaped base means 22 is a marking means 24 which is adapted to carry an inscribing member 26 which inscribes the geometric figure on the surface of the sheet material. A connecting means 28 is operatively connected on the one hand to the base means 22 and on the other hand to the marking means 24 in order to support the latter for free movement in all directions with respect to the base means 22.

An elongated bar means 30 has a lower end 32 situated next to the marking means 24 and an upper end 34 adapted to be manipulated by the operator. For this purpose the bar means 30 carries at its upper end 34 a suitable knob 36. At its lower end 32, the bar means 30 is connected with the marking means 24 by way of a lower universal joint means 38 shown in detail in FIG. 8. This lower universal joint means 38 thus provides a universal joint connection between the lower end 32 of the bar means 30 and the marking means 24.

An upper universal joint means 40 surrounds and is freely slidable with respect to the bar means 30. This upper universal joint means 40 is shown in detail in FIG. 7. A joint adjusting means 42 is operatively connected with the upper universal joint means 40 for adjusting the elevation thereof. The universal joint means 40 determines a point about which the operator can tilt the bar means 30 in all directions. By way of the adjusting means 42 it is possible to determine longitudinally of the bar means 30 the point about which the latter is capable of being tilted in all directions by the operator.

Situated above the universal joint means 40 is a template means 44. The template means 44 is formed with an opening through which the bar means 30 extends, and this opening is defined by an inner peripheral edge 46 of the template means 44. As is apparent from FIGS. 1 and 2, the inner peripheral edge 46 of the template means 44 has the general configuration of an ellipse. This inner peripheral edge 46 of the template means 44 will limit the extent to which the operator can tilt the bar means 30 about the point determined by the universal joint means 40 as the operator displaces the bar means 30 along the peripheral edge 46 so as to provide at the inscribing member 26 a line on the sheet material which will produce a geometric figure of the desired configuration and of a preselected maximum width and maximum length.

As is apparent from FIGS. 1–3 and 7, the template means 44 is inclined with respect to vertical and horizontal planes. A manually operable template adjusting means 48 is operatively connected with the template means 44 to adjust the inclination thereof, and this adjustment of the template means 44 by way of the template-adjusting means 48 as well as the adjustment of the elevation of the upper universal joint means 40 by way of the joint-adjusting means 42 will determine the maximum width and maximum length of the geometric figure, as will be apparent from the description below.

MARKING MEANS AND ASSOCIATED STRUCTURE

Figures 8, 9, 10, 13, 14, 15:
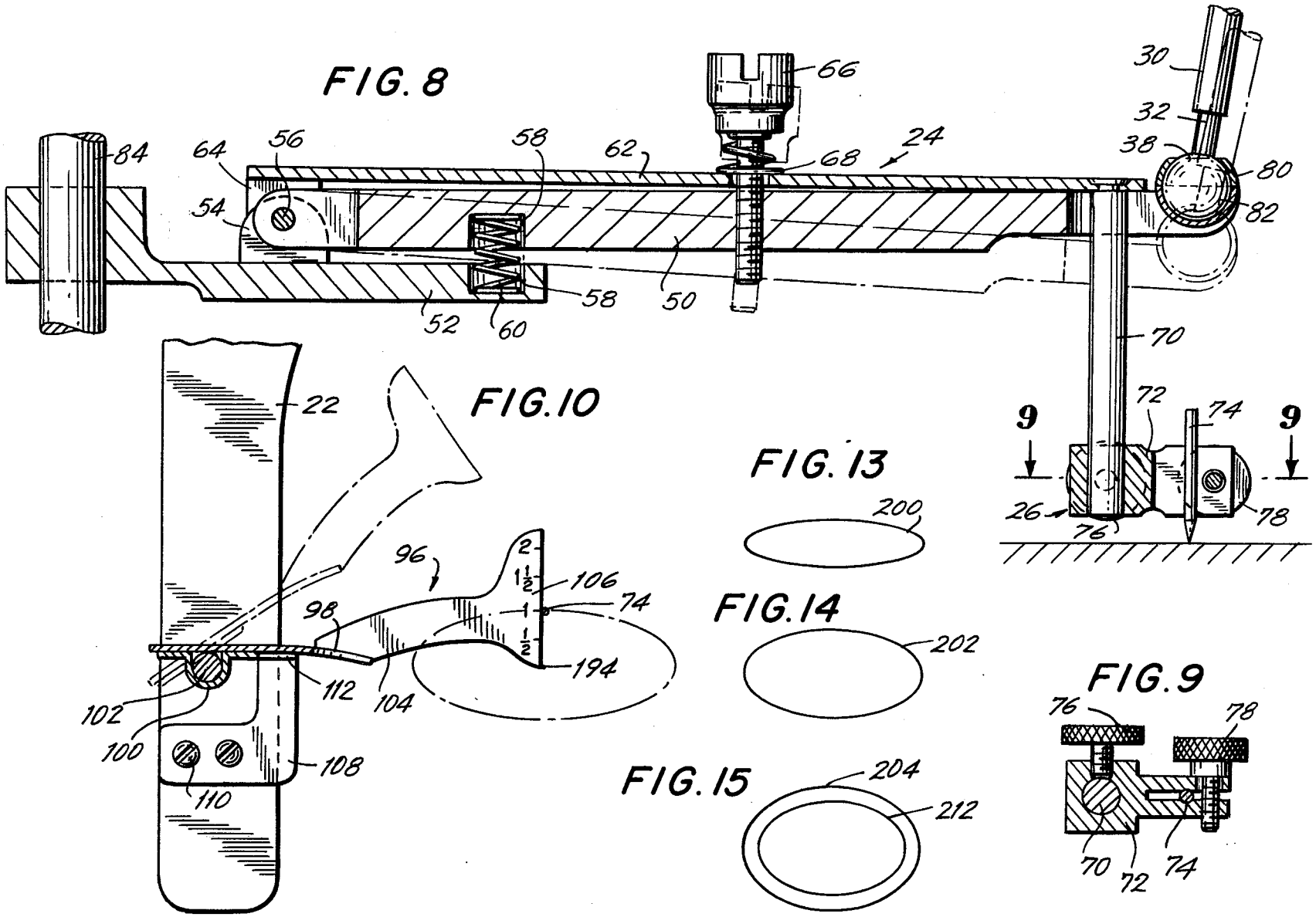
FIG. 8 is a fragmentary sectional elevation taken along line 8—8 of FIG. 1 in the direction of the arrows and showing details of the manner in which a marking means is supported.
FIG. 9 is a sectional plan view taken along line 9—9 of FIG. 8 in the direction of the arrows and illustrating the manner in which an inscribing member is carried by the marking means of FIG. 8.
FIG. 10 is a fragmentary plan view taken along line 10—10 of FIG. 2 in the direction of the arrows and showing the manner in which a gauge of the instrument of the invention is operated.
FIGS. 13–15 respectively illustrate different types of ellipses which can be made with the instrument of the invention.

The details of the marking means 24 are most clearly apparent from FIG. 8. Thus, referring to FIG. 8 it will be seen that the marking means 24 includes an elongated support member 50 pivotally connected at its rear end to a lever 52. For this purpose the lever 52 has at its outer side edges a pair of upwardly extending ears 54 which are fixed to the lever 52 and which carry the pivot pin 56 which extends horizontally through a suitable bore formed in the rear end portion of the elongated support member 50. In addition it will be seen that the elongated support member 50 and the lever 52 are formed with aligned recesses 58 which serve to house a coil spring 60 which is under compression, this coil spring 60 forming a spring means which interconnects the elongated support member 50 with the lever 52. It will be noted that the elongated support member 50 extends through a considerable distance forwardly beyond the lever 52.

Situated above the elongated support member 50 is an elongated carrier member 62 the configuration of which is most clearly apparent from FIG. 1. This carrier member 62 has at its rear end downwardly extending ears 64 between which the ears 54 are located, and the pin 56 also extends through the ears 64, as is most clearly apparent from FIG. 3. A screw 66 which can be adjusted by a suitable screwdriver extends freely through an opening formed in the elongated carrier member 62 and into threaded engagement with a threaded bore which passes through the elongated support member 50. Between the head of the screw 66 and the upper surface of the carrier member 62 is situated a compressed coil spring 68.

At its front end the carrier member 62 fixedly carries an elongated pin 70 which extends downwardly from the front end of the carrier member 62 in a substantially vertical direction. This pin 70 extends into a bore of a block 72 which serves to carry an inscribing member which in the example of FIG. 8 is a simple length of lead 74, so that the inscribing member of FIG. 8 is in the form of a suitable pencil. As is apparent from FIG. 9, the block 72 carries a set screw 76 which serves to adjustably fix the block 72 to the lower end region of the pin 70. Forwardly of the pin 70 the block 72 is longitudinally slotted so that it has a pair of elongated springy portions formed with aligned grooves which receive the pencil element 74. These springy portions can be adjustably drawn together by way of a further screw 78 illustrated most clearly in FIG. 9.

The forward end of the elongated support member 50 is suitably notched with a notch which extends longitudinally along the member 50 from the front end thereof, so that the pin 70 can extend freely through this notch. This notch at the front end region of the support member 50 is bridged by a socket member 80 which is fixed in any suitable way, as by screws, for example, to the front end of the member 50, and this socket 80 receives a ball member 82 of the lower universal joint means 38, this ball member 82 being fixed directly to the lower end 32 of the elongated bar means 30. As is apparent from the solid and dot-dash line positions for the member 50 shown in FIG. 8, it is possible for the operator to exert a downward pressure on the elongated bar means 30 so as to displace the elongated support member 50 downwardly in opposition to the force of the spring 60. This will of course cause the member 50 to also displace the screw member 66 downwardly. However, because the inscribing member 74 engages the surface of the sheet material, the carrier member 62 cannot follow the downward movement of the member 50, and instead the spring 68 is compressed in this way to an increasing extent to exert an increasing downward pressure through the carrier member 62 on the inscribing member 74. The result is that the operator can manually regulate the pressure with which the inscribing member 74 engages the surface of the sheet material. Thus the components 60 and 68 together with the parts associated therewith form a spring means yieldably resisting downward pressure by the operator to an extent which will enable the operator to regulate the pressure with which the inscribing member engages the surface of the sheet material.

As is apparent from FIG. 2 as well as FIG. 3, the socket 80 is in the form of a pair of shells situated one above the other and fastened to the upper surface of the support member 50 by way of suitable screws. Moreover, by way of the connection of the carrier member 62 to the support member 50 through the screw 66, the pin 70 of the inscribing member 26 will be carried along with whatever movement is given to the support member 50 by the operator through the bar means 30, so that the inscribing element 74 of the inscribing member 26 will precisely follow the movement imparted to the support member 50 by the operator.

The lever 52 shown in section at the left portion of FIG. 8 forms part of the connecting means 28 indicated in FIGS. 1–3. At its rear end the lever 52 of the connecting means 28 is formed with a bore through which a vertically extending pivot pin 84 extends. This pivot pin 84 is fixed at its upper and lower ends to upper and lower projecting arms of a second lever 86 of the connecting means 28. This lever 86 is formed at its end distant from the pivot pin 84 with a vertically extending bore which receives a pivot pin 88 which extends vertically and is fixed to and projects upwardly from the base means 22. Thus, the levers 52 and 86 of the connecting means 28 are free to turn one with respect to the other at the vertical pivot pin 84 while the lever 86 is free to turn wth respect to the base means 22 about the vertical pivot pin 88. As is apparent from FIG. 2, the lever 86 has horizontally extending upper and lower arms interconnected by vertically extending connecting portions which are spaced from each other, so that the weight of the structure is not excessively increased by way of the lever 86.

It is thus apparent that the connecting means 28 provides for the marking means 24 virtually complete freedom of movement in any direction in which the operator moves the marking means 24 by way of manipulation of the bar means 30.

Instead of an inscribing member 26 which includes a pencil element 74, it is possible to provide an arrangement as shown in FIGS. 11 and 12 where the inscribing element is in the form of a pen 90. Thus, as may be seen from FIGS. 11 and 12, the pin 70 adjustably carries by way of the set screw 76 a block 92 which differs from the block 72 in that it does not have springy portions drawn together by a screw for gripping the inscribing element. Instead the block 92 is formed with a bore which receives the pen 90, and the latter may be adjustably fixed to the block 92 by way of a further set screw 94. Thus, with this construction it is possible to utilize the instrument of the invention for providing an ink line rather than a pencil line. Of course the blocks 92 or 72 may be interchangeably connected with the pin 70 depending upon whether pencil or ink is desired.

A further structure which is associated with the marking means 24 is a gauge means 96 shown most clearly in FIGS. 2 and 10. The gauge means 96 is in the form of a metal strip 98 fixedly carrying a strap 100 which extends around a pivot pin 102 fixed to and extending upwardly from the base means 22 in the manner shown most clearly in FIG. 10, so that gauge means 96 is turnable about a vertical axis as well as being movable in elevation upwardly and downwardly along this vertical axis. The gauge means 96 will normally have a rest position as shown in dot-dash lines in FIG. 10, although it is also possible to turn the gauge means of FIG. 10 further in a counterclockwise direction about the pin 102 so that the gauge means rests on the base means 22 when the gauge means is in its rest position.

As is apparent from FIGS. 2 and 10, the gauge means 96 has a vertically extending strip portion which carries the strap 100 and from the vertically extending strip portion there is a downwardly extending substantially horizontal but slightly inclined portion 104 which carries a scale 106.

When the gauge means 96 is to be used it is turned to the solid line position shown in FIG. 10. This position is determined by a stop member 108 which is fixed to the base means 22 as by suitable screws 110. Thus, as is apparent from FIG. 10 the stop member 108 has a substantially L-shaped portion directly engaging the base means 22. However, at its rear end this stop member 108 has an upwardly extending lug 112 shown in FIG. 2 most clearly, and the gauge means 96 is swung into engagement with the lug 112 so as to determine the proper position of the gauge means 96 when it is used. As will be apparent from the description below, the free edge of the gauge means 96 along which the scale 106 is located directly engages the surface of the sheet material when the gauge is used, and when the gauge is in the solid line position of FIG. 10 engaging the lug 112, the zero end of the scale 106 is situated at the front end of the free edge along which the scale 106 extends. This zero graduation is placed precisely at the center of the geometric figure which is to be drawn, this figure being an ellipse in the illustrated example. Then the inscribing element such as the element 74 is placed at a selected graduation along the scale 106. In the example of FIG. 10 the element 74 is placed at a graduation which will provide an ellipse whose minor diameter is one inch. After a suitable dot has been made to determine the minor diameter the gauge means 96 is returned to its rest position and then the figure is drawn in a manner described in greater detail below.

UPPER UNIVERSAL JOINT MEANS AND ASSOCIATED STRUCTURE

The details of the upper universal joint means 40 are most clearly apparent from FIG. 7. Thus it will be seen that the upper universal joint means 40 includes a solid rigid spherical body 120 formed with a diametral bore through which the bar means 30 extends. This bore is of a circular cross section matching that of the bar means 30 so that the bar means 30 has an axis coinciding with the axis of the bore in the body 120 through which the bar means 30 extends, and the body 120 as well as the bar means 30 are freely movable one with respect to the other along this axis, as is apparent from the double-headed arrow 122 in FIG. 7. The universal joint means 40 further includes a pair of shells 124 fixed to each other and forming a socket in which the spherical member 120 is freely turnable, as is most clearly shown in FIG. 7. These shells 124 are held together by a pair of screws 126 which pass through suitable openings in the shells and which are threaded into mating threaded bores formed in an elongated carriage means 128 which is formed beneath the lower shell 124 with a relatively large opening through which the bar means 30 extends in the manner shown most clearly in FIG. 7, so that there is no interference with the movement of the bar means 30 from the carriage means 128.

The elongated carriage means 128 is formed at its opposed ends with a pair of vertically extending bores through which a pair of standards or posts freely pass. Thus, the pin 102 which serves as a pivot for the gauge means 96 is extended upwardly to form the left post or standard of FIG. 2, while extending parallel thereto is the right post or standard 132 which is shown in FIG. 2. Thus the standards 102 and 132 are fixed to and extend upwardly from the base means 22 and are parallel to each other, these posts 102 and 132 extending freely through the vertical bores at the opposed end regions of the carriage means 128. At its ends the carriage means 128 carries a pair of wing-screws 134 which can be manipulated by the operator to releasably hold the carriage means 128 at a selected elevation.

A pair of sleeves 136 and 138 are situated on and surround the posts 102 and 132 above the ends of the carriage means 128, these sleeves being fixed to the posts so as to limit the extent of upward movement of the carriage means 128.

The left block 136 which is shown in FIG. 2 also serves to fixedly support the upper end of an elongated scale 140 the bottom end of which is fixed to a block on the base means 22 which carries the post 102. Thus, the scale 140 is fixed to the block 136 by way of a screw 142 and to the block at the bottom end of the post 102 by way of a screw 144. This scale 140 includes a strip of relatively rigid metal on which are marked graduations as indicated in FIG. 2. The carriage means 128 carries at its front face an index 146 which is placed beside and in alignment with a selected one of the graduations of the scale 140, the index 146 being shown in FIG. 2 aligned with that graduation of the scale 140 which indicates that an ellipse having a major axis of three inches will be produced.

Thus, in order to set the carriage 128 at a selected elevation the operator need only loosen the wing screws 134 and raise or lower the carriage means 128, and then when the carriage means 128 has been situated at a selected elevation the wing screws 134 will be tightened. Thus it will be seen that FIG. 2 shows in phantom lines the carriage means 128 situated also at an elevation which will provide an ellipse whose major axis has a length of one inch.

It is thus apparent that by way of the upper universal joint means 40, it is possible to determine a selected point along the axis of the bar means 30 about which the latter can be tilted in all directions by the operator. Thus the bar means 30 will remain connected at its bottom end to the lower universal joint means 38 while the carriage means 128 is adjusted in elevation. In this way the situation of the point corresponding to the center of the ball member 120 along the axis of the bar means 30 can be selected for the purpose of achieving a geometric figure of a selected magnitude, as will be apparent from the description below.

TEMPLATE MEANS AND ASSOCIATED STRUCTURE

As has been indicated above, the template means 44 is in the form of a flat sheet of metal or the like formed with an inner peripheral edge 46 defining the opening through which the bar means 30 extends, and it is along this edge 46 that the bar means 30 is moved by the operator in order to provide the desired geometric figure. Also, as was indicated above, the template means 44 is associated with a template adjusting and compensating means 48.

This latter assembly of the template means 44 and the template-adjusting and compensating means 48 is carried by a support member 150 in the form of a rigid metal sheet which is itself of a primarily elliptical configuration, as is apparent from FIG. 1. The ends of the support member 150 are formed with openings through which the posts 102 and 132 extend, and these ends of the support member 150 rest on a pair of nuts 152 threaded onto the upper end regions of the posts 102 and 132. The support member 150 is fixed in position by way of upper nuts 154. Thus it will be seen that the posts or standards 102 and 132 serve to support most of the components which are situated above the base means 22, such as the carriage 128, the template and template-adjusting means, and of course the gauge means 96.

As is apparent from FIG. 1, the support member 150 if formed with a relatively large opening 156 of substantially elliptical configuration. At the opposed ends of the opening 156 the support member 150 has a pair of integral downwardly extending ears 158 which fixedly carry a pair of coaxial pivot pins 160 which extend into bores formed in a cradle member 162 of the compensating means. The cradle member 162 has a lower substantially U-shaped portion 164 which carries a limiting means 166 in the form of a suitable screw situated beneath the rear portion of the support member 150, so that the cradle member 162 can only turn in a clockwise direction about the common axis of the pins 160 to the dot-dash line position indicated in FIG. 7.

It will be seen that the cradle member 162 has at the front ends of the substantially U-shaped portion 164, where the coaxial pivot pins 160 are located, a pair of upwardly extending legs 166 formed at their upper end regions with a pair of coaxial bores which receive a pair of coaxial pivot pins 168 which are fixed to the opposed ends of the template means 44, the left pin 168 of FIG. 2 having an enlarged portion situated next to the left portion 166 of the cradle 162. This left pin 168 of FIG. 2 not only is fixed to the template 44 but also is fixed to a member 170 of the template adjusting means 48. This member 170 is in the form of a strip of metal having the configuration which is most clearly apparent from FIGS. 1–3. This member 170 is made of a substantially rigid metal sheet. Thus, the left end of the metal sheet 170, as viewed in FIG. 3, is fixed directly to the pin 168 shown at the left of FIG. 2. Instead of having an enlarged portion, the left pin 168 of FIG. 2 can have the same diameter as the right pin 168 of FIG. 2 and can instead extend through a suitable spacer sleeve situated between the member 170 and the left portion 166 of cradle 162, as viewed in FIG. 2.

From its left portion which is fixed to the pin 168 as shown in FIG. 3, the member 170 is angled forwardly and toward the left, as viewed in FIGS. 1 and 2, and at its front end the member 170 has a downwardly extending curved portion 172 formed with an arcuate slot 174 of predetermined curvature and carrying at its upper end a knob 176 which may be engaged by the operator for manipulating the adjusting means 48.

At its left end portion, as viewed in FIGS. 1 and 2, the support member 150 has integrally formed therewith a substantially L-shaped portion 180 which terminates at its front left edge region in an upwardly extending ear 182 which fixedly carries a horizontally extending screw member 184 which passes through the arcuate slot 174 and carries beyond the slot 174 a nut 186 which engages one end of a coil spring 188 which is compressed between the nut 186 and the portion 172 of the member 170. Thus the nut 186 may be turned to adjust the compressive force of the spring 186, and this spring will serve to frictionally maintain the member 170 in the adjusted position in which it is manually set by manipulation of the knob 176.

It is clear, therefore, that the screw 184 and the slot 174 form a pin-and-slot connection of the adjusting means 48 to the support member 150. Moreover, it will be clear that the coaxial pins 168 form the turning axis for the template means 44 itself, and this latter axis is in the form of a shiftable horizontal axis. The horizontal axis defined by the coaxial pivot pins 160 remains stationary. Thus the axis of the pins 168 is a movable horizontal axis capable of being moved with respect to the stationary horizontal axis of the pins 160.

As the member 172 is displaced downwardly with respect to the pin 184 so that the top end of the slot 174 approaches the pin 184, the pins 168 together with the template 44 and the cradle 162 turn in a clockwise direction about the stationary axis of the pins 160, and the limit of this turning is shown in dot-dash lines in FIG. 7 where the limiting screw 167 engages the fixed support member 150. In this limiting position the shiftable axis of the pins 168 will be situated directly over the stationary axis of the pins 160. As the member 170 is displaced upwardly by manipulation of the knob 176 so as to displace the slot 174 upwardly with respect to the pin or screw 184, the movable axis defined by the pins 168 will be shifted toward the left, as viewed in FIGS. 3 and 7. When the top end of the slot 174 is next to the pin or screw 184, the template 44 is inclined to its greatest extent, which is to say it most closely approaches a vertical plane. As the lower end of the slot 174 is displaced upwardly toward the screw 184, the template 44 is turned in a counterclockwise direction about the axis formed by the pins 168, as viewed in FIGS. 3 and 7, and the template 44 may be moved to the substantially horizontal position shown in dot-dash lines in FIG. 7, with the axis of the pins 168 at this time being displaced to the greatest extent to the left from the end position directly over the axis of the pins 160. This arrangement thus provides not only an adjustment for adjusting the inclination of the template 44 but also an adjustment of an extent of compensation determined by the shifting of the turning axis defined by the pins 168. This compensation is provided for a purpose referred to below.

OPERATION

With the particular template means 44 shown in the drawings and described above it is possible to draw ellipses of various sizes and having various relationships between their maximum length and maximum width. Thus, referring to FIG. 4 it will be seen that on the fragmentarily illustrated sheet 190 an ellipse 192 is to be drawn, this ellipse having a maximum length L representing the major axis of the ellipse and a maximum width W representing the minor axis of the ellipse.

The operator who wishes to provide a maximum length L for the geometric figure 192 will first set the carriage means 128 at the height required for this purpose. For example if the dimension L is to be 3 inches then the operator will set the carriage 128 at the elevation shown in solid lines in FIG. 2. If the maximum length L is to be 1 inch, then the carriage 128 will be set at the elevation shown in dot-dash lines in FIG. 2. Thus the operator will first determine the elevation of the universal joint means 40 so as to determine the point along the axis of the bar means 30 about which the latter will be tilted while providing the desired geometric figure. As is apparent from FIG. 6, the relationship between the opposite ends of the template guiding edge 46 and the tilting point determined by the universal joint means 40 along the bar 30 is such that the lower the elevation of the universal joint means 40, the shorter will be the dimension L, while the higher the elevation of the joint means 40, the longer the dimension L. The relationship between the elevation of the template means 44 and the lower universal joint means 40 is taken into consideration in determining the spacing between the graduations of the scale 140, and the distances between these graduations are empirically determined for the particular dimensions of the components of the instrument so that it will be known that at the various elevations indicated by the graduations of the scale 140 the length L will be provided. This relationship is apparent from FIG. 6 as well as FIG. 2.

As has been indicated above, the dimension W will be determined by the gauge means 96. This gauge means is set at it solid line position shown in FIG. 10 with the zero graduation of the scale 106 situated at the center 194 of the geometric figure. This center 194 will of course be initially determined on the sheet 190 by the operator. Thus, with the zero graduation of scale 106 situated at the center 194, the operator will place the inscribing element, such as element 74 or element 90 next to that graduation of the scale 106 which corresponds to the desired maximum width W. In the example of FIG. 10 the element 74 is shown set to provide a dimension W equal to 1 inch.

While the operator holds the inscribing element 74 or 90 next to the desired graduation along the scale 106, the bar 30 will assume a given inclination determined by the location of the inscribing element next to the desired graduation of the scale 106. With the inscribing element thus held against the selected graduation of the scale 106 to determine the inclination the bar 30, the operator will manipulate the knob 176 so as to tilt the template 44 until the lower front region of the edge 46 thereof engages the bar 30. In other words with one hand the operator will hold the inscribing element against the desired graduation of the scale 106 and with the other hand the operator will engage the knob 176 and turn the member 170 until the edge 46 of the template just comes into engagement with the bar 30 without displacing the latter. The friction provided by the compressed spring 188 will maintain the adjusting means 48 in its adjusting position.

It is to be noted that the curvature of the slot 174 is such that the axis of the pins 168 will of course move depending upon the extent to which the member 170 is turned by the operator to detemine the inclination of the template 44. However this axis of the pins 168 moves primarily in a horizontal plane. Its vertical deflection is extremely small so that there is no perceptible influence on the adjustment previously provided by determining the elevation of the carriage 128.

The operations carried out during this latter part of the adjustment are apparent from FIG. 5. Thus, the operator will set the inscribing element 74 at a position indicated in the solid line in FIG. 5 to incline the bar 30 upwardly and toward the right as viewed in FIG. 5 in the solid line position thereof shown in FIG. 5, and of course the template 44 will then be adjusted so that the lower front region of the edge 46 engages the bar 30. This will result in a displacement of the axis of the pins 168 toward the left, as viewed in FIG. 5, as the template 44 is turned in a counterclockwise direction about the axis of the pins 168.

The compensation provided by way of this shiftable axis improves the accuracy of the instrument because as the bar 30 is moved along the edge 46 this edge changes its elevation with respect to the bar 30. Thus the upper left portion of the template 44, as shown in FIG. 5, has a higher elevation with respect to the bar 30 than the lower right portion of the template. As the template 44 is turned in a counterclockwise direction, as viewed in FIG. 5, the extent to which the bar 30 can be swung about the point determined by the universal joint means 40 in a counterclockwise direction, as viewed in FIG. 5, increases. As a result, the more the template 40 is turned from its almost vertical position toward a horizontal position, the greater the extent to which the element 74 will be displaced toward the right, as viewed in FIG. 5, and thus the greater will be an unavoidable distortion in the geometric figure resulting from the tilting of the template 44. This tiliting is highly desirable because of the simplicity of the structure and the ease of the adjustment thereof. Thus, by shifting the axis defined by the pins 168 toward the left as the template 44 approaches a horizontal position, this tendency to provide a distorted figure which will be distorted toward the right is compensated. The configuration of the inner peripheral edge 46 of the template means 44 is determined empirically so as to provide an extremely precise geometric figure, an ellipse in the illustrated example, when the index 146 is approximately midway along the scale 140 and when the inscribing element is approximately midway along the scale 106. Thus, if in the illustrated example the operator selects for the ellipse a major axis of approximately two inches and a minor axis of approximately 1 inch, the configuration of the edge 46 is such that an extremely precise ellipse will be provided. It has been found that with the above-described structure of the invention the use of the compensating means will enable in this way extremely precise ellipses to be drawn throughout the entire ranges of the scales 140 and 106, these figures drawn throughout the ranges of these scales having no perceptible distortion in practice.

It is to be noted that by selection of suitable graduations along these scales it is possible to achieve a wide variety of sizes of the particular geometric figure. Thus FIG. 13 shows an ellipse 200 which may have a minimum minor axis on the order of a length of one half inch and a maximum length on the order of 2 inches, although this length can be increased as desired up to 3 and a half inches with the scale 140 shown in FIG. 2. On the other hand, FIG. 14 shows an ellipse 202 having the same length but a different width. Thus the carriage 128 will remain in the same position to achieve the ellipses of FIGS. 13 and 14 while the only difference will be the situation of the element 74 along the scale 106. Thus in this way it is possible alter the relationship between the maximum length and maximum width of the desired figure. Moreover, as is apparent from FIG. 15, it is possible to provide a pair of substantially concentric ellipses 202 and 204. Ellipse 202 of FIG. 15 may be the same as that of FIG. 14 and this ellipse is shown as being surrounded by an outer ellipse 204. To achieve the outer ellipse 204 the operator was only required to move the carriage 128 up to the next graduation of the scale 140 while the element 74 is then moved to the next graduation of the scale 106.

Thus, assuming that the operator has set the carriage means 128 to provide the desired length L and the inscribing element to provide the desired width W, the operator will then, after adjusting the template means as referred to above, simply return the gauge means 96 to its rest position. Then while starting with the bar 30 in engagement with the lower front region of the edge 46, the operator will displace the bar 30 along this edge 46. Thus, assuming that the operator starts with the instrument in the position of FIGS. 1–3 and 7, then the inscribing element will be situated at the dot 206 shown in FIG. 4. If the operator now moves the bar 30 to the right along the edge 46 as viewed in FIG. 2, so that the bar 30 swings in a clockwise direction as viewed in FIG. 2, during the initial movement of the bar 30, then the inscribing element will move along the ellipse 192 from the dot 206 in the direction of the arrows shown in FIG. 3, the inscribing element progressing first to the left up to the end of the ellipse 192 and then to the right while inscribing the lower portion of the ellipse as viewed in FIG. 4, and so on back to the dot 206. Of course, the bar 30 progresses along the edge 46 in the same direction but always has a location along the edge 46 which is directly opposite to the location of the inscribing element at any given instant.

Of course, it is apparent that while the invention has been shown and described in connection with a geometric figure in the form of an ellipse, the invention can equally well be used with other geometric figures such as rectangles, pentagons, hexagons, and the like. By way of the structure of the invention it is not only possible to provide a predetermined geometric figure but also it is possible to preselect the maximum length and maximum width of the particular geometric figure.

What is claimed is:

1. In an instrument for producing on the surface of a sheet material a given geometric figure having a preselected maximum length and a preselected maximum width, base means adapted to rest on the surface of the sheet material during formation of the given geometric figure thereon, marking means adapted to carry an inscribing member which has a tip for engaging the surface of the sheet material for inscribing the given figure thereon, connecting means operatively connected with said base means and marking means for supporting said marking means while providing for said marking means complete freedom of movement with respect to said base means, elongated manually operable bar means having a lower end next to said marking means and an upper end distant therefrom and adapted to be manipulated by the operator, lower universal joint means connecting said lower end of said bar means to said marking means for providing a universal joint connection between said marking means and bar means at the lower end of the latter, upper universal joint means surrounding and engaging said bar means between said upper and lower ends thereof and being freely shiftable longitudinally of said bar means for providing at a selected location longitudinally of said bar means a point about which said bar means can be manually turned in all directions, joint-adjusting means carried by said base means and operatively connected with said upper universal joint means for adjusting the elevation thereof with respect to said base means for determining the location of said point along said bar means, template means for guiding said bar means when the latter is manipulated by the operator during turning with respect to said point, said template means being situated along said bar means at an elevation different from said upper universal joint means and being formed with an opening through which said bar means extends, said template means having an inner peripheral edge defining said opening and having the general configuration of said given figure, and template-adjusting means also carried by said base means and operatively connected with said template means for adjusting the latter with respect to said bar means for controlling the extent to which said bar means can be tilted about said point as said bar means is moved along said inner peripheral edge of said template means to provide by way of said marking means said given figure on said surface of said sheet material, the adjustment of said upper universal joint means and said template means by way of said joint-adjusting means and template-adjusting means determining the magnitude of the geometric figure produced on the surface of the sheet material and the relationship between the length and width thereof, said template-adjusting means supporting the template means for tilting movement about a substantially horizontal axis and said inner peripheral edge of said template means being situated on one side of said horizontal axis at an elevation lower than said horizontal axis and at the opposite side of said horizontal axis at an elevation higher than said horizontal axis, and said template adjusting means including a compensating means for changing the location of said horizontal axis depending upon the inclination of said template means to compensate for inaccuracies which otherwise would occur if said horizontal axis were to remain stationary.

2. The combination of claim 1 and wherein said inner peripheral edge of said template means defines an ellipse, for producing an elliptical figure of preselected maximum length and width on the surface of the sheet material.

3. The combination of claim 1 and wherein said template means is situated at an elevation higher than said upper universal joint means.

4. The combination of claim 1 and wherein a gauge means is movably carried by said base means for movement with respect thereto to and from a position engaging the surface of the sheet material, said gauge means carrying a scale for indicating the center of said given figure and for cooperating with the inscribing member to determine one of the maximum and minimum dimensions of the figure by placing a predetermined part of said inner peripheral edge of said template means in engagement with said bar means when said inscribing member is situated at a selected graduation of said scale of said gauge means.

5. The combination of claim 4 and wherein said base means carries a substantially upright pivot pin around which said gauge means is turnable for movement with respect to said base means to and from said position engaging the surface of the sheet material, and said base means also carrying a stop member to be engaged by said gauge means for determining the location of said gauge means when the latter is in said position engaging the surface of the sheet material.

6. The combination of claim 1 and wherein said template means and template-adjusting means are situated at an elevation higher than said joint-adjusting means and said upper universal joint means, standard means carried by and extending upwardly from said base means and carrying said template-adjusting means as well as said compensating means thereof, said template-adjusting means and compensating means thereof including a support fixed to said standard means so as to be stationary with respect thereto, a cradle, pivot means pivotally connecting said cradle with said support for swinging movement with respect thereto about a stationary horizontal axis, said cradle being pivotally connected with said template means for supporting the latter to turn about a shiftable horizontal axis, the latter moving with respect to said stationary horizontal axis when said cradle turns with respect to said stationary horizontal axis, and manually operable means operatively connected with said template means for turning the latter with respect to said cradle to adjust the angle of inclination of said template means, said manually operable means having a pin-and-slot engagement with respect to said support for determining the extent to which said shiftable horizontal axis is displaced with respect to said stationary horizontal axis during adjustment of said template means.

7. The combination of claim 6 wherein said manually operable means includes a member formed with an arcuate slot of predetemined configuration and a pin carried by said support and extending through said slot for determining the position of said shiftable axis during tilting of said template by manipulation of said manually operable means.

8. The combination of claim 7 and wherein a limiting means is carried by said cradle for engaging said support to determine one limit of adjustment of said template means.

9. The combination of claim 6 and wherein a carriage means carries said upper universal joint means and is vertically movable along said standard means for adjusting the elevation of said upper universal joint means, whereby said standard means carries both said joint-adjusting means and said template-adjusting means.

10. The combination of claim 9 and wherein a vertically extending scale means is fixed with said standard means and extends along the path of movement of said carriage means, the latter having a reference for cooperating with said vertically extending scale means to indicate the elevation of said upper universal joint means for providing at the latter vertically extending scale means an indication of one of the maximum preselected dimensions of the given geometric figure.

11. The combination of claim 1 and wherein said connecting means includes a pair of levers pivotally connected to each other for movement one with respect to the other about a vertical axis, one of said levers being pivotally connected with said base means for turning movement with respect thereto about a vertical axis and the other of said levers being pivotally connected with said marking means for rendering said marking means and other lever movable one with respect to the other about a horizontal axis.

12. The combination of claim 11 and wherein said marking means includes an elongated member pivotally carried by said other lever and extending beyond said other lever and connected with said lower universal joint means, said elongated member carrying a means for receiving the inscribing member, and spring means connecting said elongated member with said other lever for yieldably and resiliently resisting movement of said elongated member with respect to said other lever for providing the operator with the option of manually determining the pressure with which the inscribing member engages the surface of the sheet material.

* * * * *